US008333465B2

(12) United States Patent
Byun et al.

(10) Patent No.: US 8,333,465 B2
(45) Date of Patent: Dec. 18, 2012

(54) ROLL-TO-ROLL PRINTING SYSTEM AND METHOD

(75) Inventors: Do Young Byun, Seoul (KR); Kee Hyun Shin, Gyeonggi-do (KR); Ji Hoon Kim, Gyeonggi-do (KR); Si Bui Quang Tran, Seoul (KR); Vu Dat Nguyen, Seoul (KR)

(73) Assignee: Konkuk University Industrial Cooperation Corp., Seoul (KR)

( * ) Notice: Subject to any disclaimer, the term of this patent is extended or adjusted under 35 U.S.C. 154(b) by 208 days.

(21) Appl. No.: 12/993,587

(22) PCT Filed: Sep. 8, 2008

(86) PCT No.: PCT/KR2008/005285

§ 371 (c)(1),
(2), (4) Date: Nov. 19, 2010

(87) PCT Pub. No.: WO2010/002068

PCT Pub. Date: Jan. 7, 2010

(65) Prior Publication Data

US 2011/0074859 A1 Mar. 31, 2011

(30) Foreign Application Priority Data

Jun. 30, 2008 (KR) ..... 10-2008-0062203

(51) Int. Cl.
*B41J 2/015* (2006.01)

(52) U.S. Cl. ..... 347/101; 347/38; 347/20; 347/16

(58) Field of Classification Search ..... 347/9, 11, 347/13, 16, 20, 38, 40, 42, 101, 104, 105
See application file for complete search history.

(56) References Cited

U.S. PATENT DOCUMENTS

| | | | | |
|---|---|---|---|---|
| 5,213,036 | A | 5/1993 | Tokuno et al. | |
| 7,712,433 | B2 * | 5/2010 | Lim | 118/313 |
| 7,724,404 | B2 * | 5/2010 | Mercer | 358/474 |

FOREIGN PATENT DOCUMENTS

| | | | |
|---|---|---|---|
| JP | 2535428 | B2 | 9/1996 |
| JP | 11188901 | A | 7/1999 |
| JP | 2007139920 | A | 6/2007 |
| KR | 20030067348 | A | 8/2003 |

OTHER PUBLICATIONS

Search Report for PCT/KR2008/005285, dated Dec. 26, 2008, 2 pages.

* cited by examiner

*Primary Examiner* — Juanita D Jackson
(74) *Attorney, Agent, or Firm* — Dority & Manning, P.A.

(57) ABSTRACT

Disclosed are a roll-to-roll printing system and method in which a large number of micro-nozzles are formed directly in a printing roll, and thus ink supplied to the central portion of the roll can be formed into micro-inkjets by inducing an electrostatic field, and furthermore, as a result of the formation of the micro-inkjets, a micro-sized pattern significantly smaller than that achievable by a prior pattern formation method can be printed on a print medium, and in addition, the relative speed of the print medium relative to the roll can be maintained at a speed close to "0" so as to improve the resolution, integration density and precision of the printed pattern.

According to the present invention, a large amount of micro-nozzles are formed directly in a printing roll, and thus ink supplied to the central portion of the roll can be formed into micro-inkjets by inducing an electrostatic field.

6 Claims, 8 Drawing Sheets

ROLL-TO-ROLL PRINTING SYSTEM AND METHOD

CROSS REFERENCE TO RELATED APPLICATION

This application is the national stage entry of International Patent Application No. PCT/KR2008/005285 having a filing date of Sep. 8, 2008, which claims the filing benefit of Korean Patent Application Number 10-2008-0062203 having a filing dates of Jun. 30, 2008.

TECHNICAL FIELD

The present invention relates to a roll-to-roll printing system and method, and more particularly a roll-to-roll printing system and method in which a large number of micro-nozzles are formed directly in a printing roll, and thus ink supplied to the central portion of the roll can be formed into micro-inkjets by inducing an electrostatic field, and furthermore, as a result of the formation of the micro-inkjets, a micro-sized pattern significantly smaller than that achievable by a prior pattern formation method can be printed on a print medium, and in addition, the relative speed of the print medium relative to the roll can be maintained at a speed close to "0" so as to improve the resolution, integration density and precision of the printed pattern.

BACKGROUND ART

Microelectromechanical systems (MEMS) or nanoelectromechanical systems (NEMS) technology for highly integrated microstructures, which is based on semiconductor processing technology, is fundamentally performed through deposition and etching processes using chemical reactions, and thus the emission of hazardous substances, such as etchants, reaction gases, and materials remaining after reaction becomes a serious problem.

Meanwhile, inkjet printer head technology is expected to be applied in various fields, and in order to overcome the above-described problem, technology capable of achieving a relative reduction in the emission of hazardous substances by forming patterns selectively only at desired portions using the inkjet printer head technology is also used in semiconductor manufacturing processes in the IT field.

Particularly, as the market size of the display industry rapidly grows with the rapid development of the flat-panel display industry, the display industry is under pressure from declining price along with technical challenges arising from trends towards becoming more lightweight, slim and large-scale. For this reason, the inkjet printer head technology capable of considerably reducing the number of processes compared to existing semiconductor processing technology was recognized as a new technology for ensuring market competitiveness and has been actively studied. Moreover, the application of the inkjet printer head technology is gradually expanding to, in addition to the display industry, various others involving microsensors, biochips, RFID, micro-antennas, biological cell cultures, etc.

The technology of ejecting fluid in the form of droplets using an electrostatic field has been applied in various applications, including coating or particle production processes, and also to mass spectrometry for protein analysis. In addition, the development of inkjet heads employing an electrostatic field was recently reported, but there is no report on combining the inkjet head with roll-to-roll printing technology.

The roll-to-roll printing technique has been actively studied in fields such as RFID, because it has an advantage in that it can manufacture devices at high speed. However, it has a disadvantage in that it is difficult to form micropatterns, having a very small linewidth, and multi-patterns.

Meanwhile, an electrohydrodynamic (EHD) inkjet system has an advantage in that it can form very small patterns, but is disadvantageous in that the patterning speed thereof is slower than that of the roll-to-roll printing system. Therefore, there is a need for a technology capable of performing printing using the roll-to-roll printing system in combination with an electrohydrodynamic (EHD) inkjet system.

DISCLOSURE

Technical Problem

The present invention has been made in order to solve the above-described problems occurring in the prior art, and it is an object of the present invention to provide a roll-to-roll printing system and method, in which a large number of micro-nozzles are formed directly in a printing roll, and thus ink supplied to the central portion of the roll can be formed into micro-inkjets by inducing an electrostatic field, and furthermore, as a result of the formation of the micro-inkjets, a micro-sized pattern significantly smaller than that achievable by a prior pattern formation method can be printed on a print medium, and in addition, the relative speed of the print medium relative to the roll can be maintained at a speed close to "0" so as to improve the resolution, integration density and precision of the printed pattern.

Technical Solution

To achieve the above object, the present invention provides a roll-to-roll printing system, including: a printing roller unit having pluralities of droplet-ejecting inkjet heads arranged at the outer circumferential portion thereof, each of the droplet-ejecting inkjet heads comprising a body, a chamber formed in the body so as to receive a given amount of fluid, a nozzle for ejecting the fluid, formed at one side of the body so as to communicate with the chamber, and an actuator for forming an electrostatic field so as to eject the fluid through the nozzle; a transport roller unit comprising upper rollers, which rotate so as to feed a print medium into a space above the printing roller unit, and lower rollers, which rotate so as to feed the print medium into a space below the printing roller unit; a print medium sensor unit comprising a position sensor for sensing the position of the print medium, which is fed into each of the spaces above and below the printing roller unit by the upper rollers and the lower rollers, a feed speed sensor for sensing the feed speed of the print medium, which is fed into each of the spaces above and below the printing roller unit by the upper rollers and the lower rollers, and a vibration sensor for sensing the vibration of the print medium, which is fed into each of the spaces above and below the printing roller unit by the upper rollers and the lower rollers; a roller sensor unit comprising a print roller sensor for sensing the rotating speed of the printing roller unit, an upper roller sensor for sensing the rotating speed of the upper rollers, and a lower roller sensor for sensing the rotating speed of the lower rollers; and a control unit for controlling the rotation of the printing roller unit, the upper rollers and the lower rollers on the basis of the information sensed in the print medium sensor unit and the roller sensor unit.

In the roll-to-roll printing system of the present invention, the control unit may control the rotation of the printing roller unit, the upper rollers and the lower rollers, such that the relative speed of the print medium, which is fed into each of the spaces above and below the printing roller unit, relative to the outer circumferential surface of the printing roller unit, which rotates, is close to "0".

In the roll-to-roll printing system of the present invention, the printing roller unit, the upper rollers and the lower rollers may rotate in a forward or reverse direction, such that the print medium can be fed in either direction.

In the roll-to-roll printing system of the present invention, an electrical signal for forming the electrostatic field in the actuator of the droplet-ejecting inkjet head may be a continuous DC voltage signal, a signal for forming an electrostatic field in the form of a DC voltage pulse, an AC voltage signal having a specific frequency, or a continuous DC signal which is applied along with AC voltage.

In the roll-to-roll printing system of the present invention, a pattern mask may be provided on the surface of the printing roller unit, such that a pattern is formed on the surface of the print medium by forming an electrostatic field between the nozzle and the pattern mask.

In another aspect, the present invention provides a roll-to-roll printing method, including the steps of: providing a printing roller unit having pluralities of droplet-ejecting inkjet heads arranged at the outer circumferential portion thereof, each of the droplet-ejecting inkjet heads comprising a body, a chamber formed in the body so as to receive a given amount of fluid, a nozzle for ejecting the fluid, formed at one side of the body so as to communicate with the chamber, and an actuator for forming an electrostatic field so as to eject the fluid through the nozzle; feeding a print medium into a space above or below the printing roller unit; sensing the position, feed speed and vibration of the print medium, and controlling the rotating speed of the printing roller unit and the feed speed of the print medium on the basis of the sensed values of position, feed speed and vibration of the print medium, such that the relative speed of the print medium, which rotates, relative to the outer circumferential surface of the printing roller unit, is close to "0"; and forming an electrostatic field, such that the fluid is ejected through the nozzle.

Advantageous Effects

As described above, in the present invention, a large amount of micro-nozzles are formed directly in a printing roll, and thus ink supplied to the central portion of the roll can be formed into micro-inkjets by inducing an electrostatic field.

Furthermore, as a result of the formation of the micro-inkjets, a micro-sized pattern significantly smaller than that achievable in a prior pattern formation method can be printed on a print medium.

In addition, the relative speed of the print medium relative to the roll can be maintained at a speed close to "0", and thus the resolution, integration density and precision of the printed pattern can be improved.

DESCRIPTION OF IMPORTANT REFERENCE NUMERALS USED IN THE FIGURES

Figure 1:
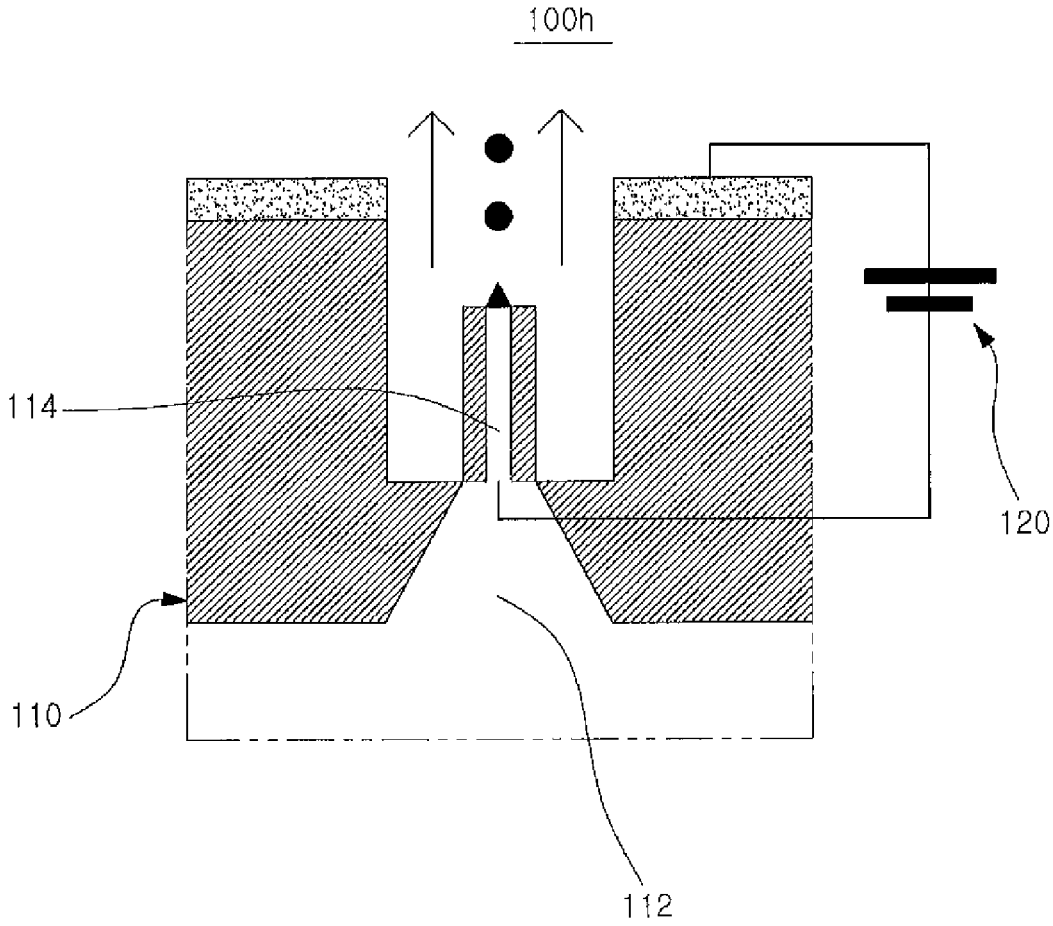
FIG. 1 is a schematic diagram illustrating the drop-ejecting inkjet head of a roll-to-roll printing system according to one embodiment of the present invention.
Figure 2:
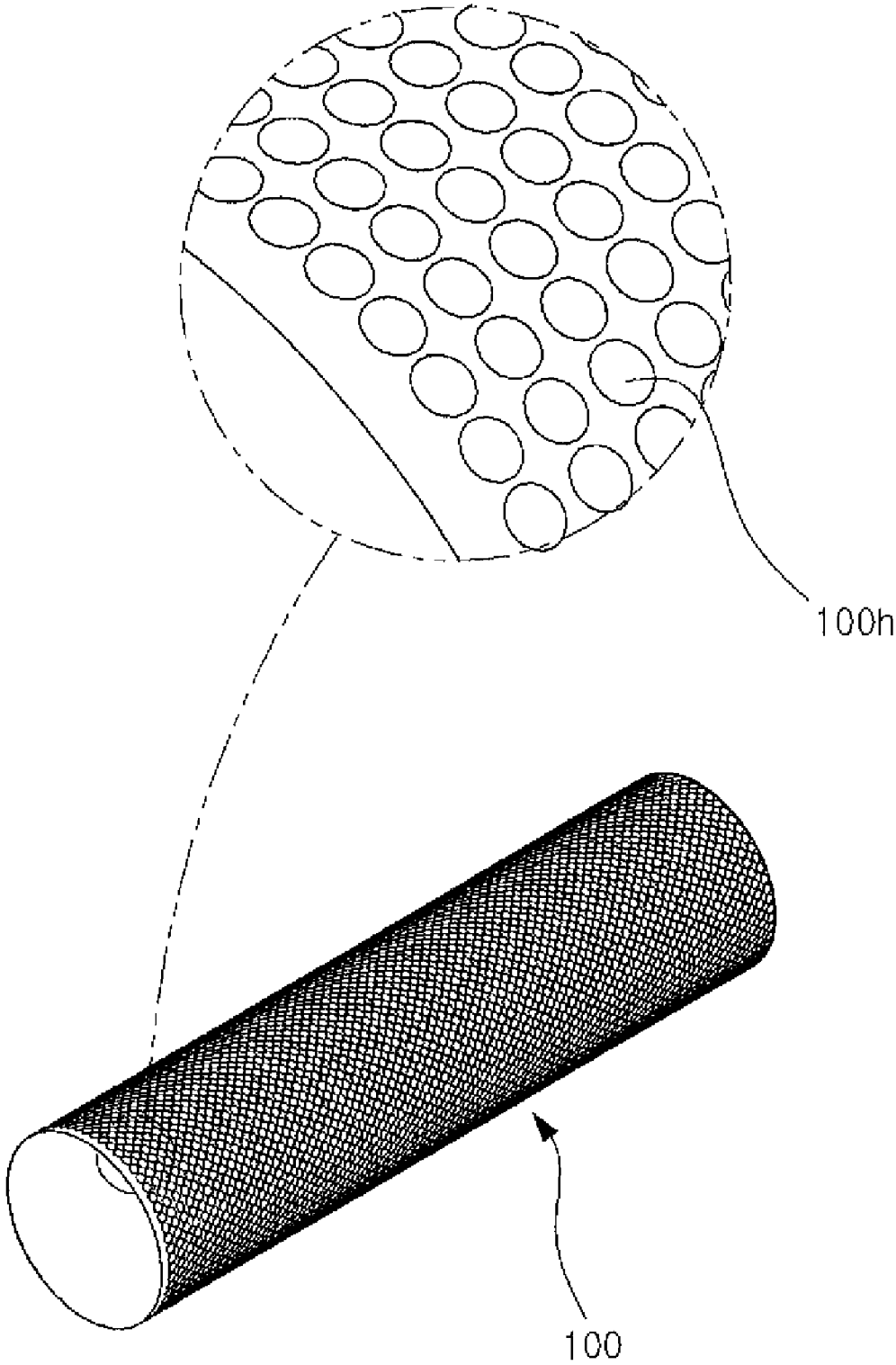
FIG. 2 is a perspective view of the printing roller unit of a roll-to-roll printing system according to one embodiment of the present invention.
Figure 3:
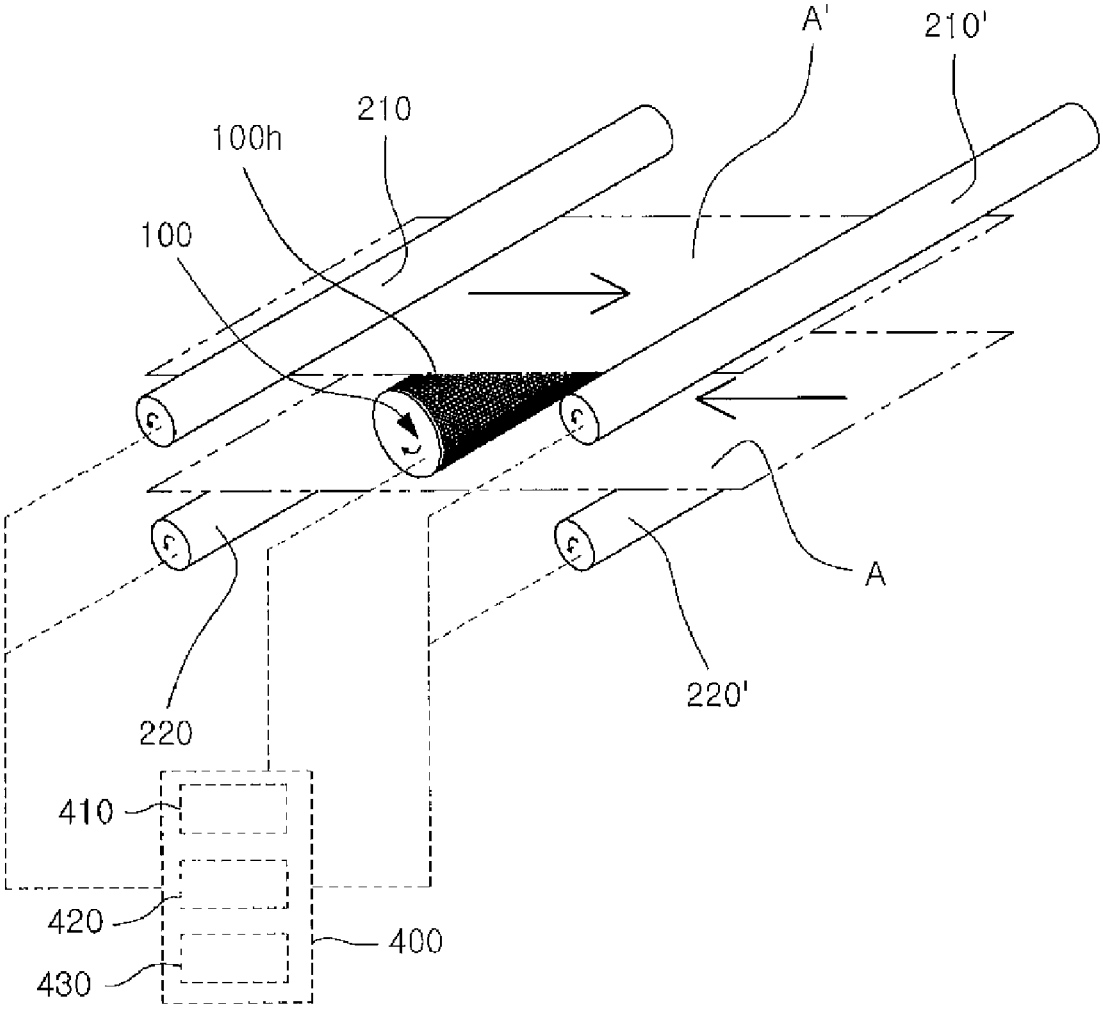
FIG. 3 is a conceptual diagram showing a roll-to-roll printing system according to one embodiment of the present invention.

100: printing roller unit;
**100*h***: droplet-ejecting inkjet head;
110: body;
112: chamber;
114: nozzle;
200: transport roller unit;
210: upper rollers;
220: lower rollers;
300: print medium sensor unit;
310: position sensor;
320: feed speed sensor;
330: vibration sensor;
400: roller sensor unit;
410: printing roller sensor;
420: upper roller sensor;
430: lower roller sensor;
500: control unit;
A: print medium; and
P: pattern mask.

MODE FOR INVENTION

The present invention will be apparent from the following preferred embodiments with reference to the accompanying drawings. Hereinafter, the present invention will be described in detail, such that those skilled in the art can easily understand and reproduce the invention through the embodiments of the invention.

A roll-to-roll printing system according to the present invention comprises a printing roller unit 100, a transport roller unit 200, a print medium sensor unit 300, a roller sensor unit 400 and a control unit 500.

The printing roller unit 100 has pluralities of droplet-ejecting inkjet heads **100*h* arranged at the outer circumferential portion thereof, each of the droplet-ejecting inkjet heads 100 comprising a body 110, a chamber 112 formed in the body 110 so as to receive a given amount of fluid, a nozzle 114 for ejecting the fluid, formed at one side of the body 110 so as to communicate with the chamber 112, and an actuator 120 for forming an electrostatic field so as to eject the fluid through the nozzle 114**.

The transport roller unit 200 comprises upper rollers 210, which rotate so as to feed a print medium A into the space above the printing roller unit 100, and lower rollers 220, which rotate so as to feed the print medium into the space below the printing roller unit 100.

The print medium sensor unit 300 comprises a position sensor 310 for sensing the position of the print medium A, which is fed into each of the spaces above and below the printing roller unit 100 by the upper rollers 210 and the lower rollers 220, a feed speed sensor 320 for sensing the feed speed of the print medium A, which is fed into each of the spaces above and below the printing roller unit 100 by the upper rollers 210 and the lower rollers 220, and a vibration sensor for sensing the vibration of the print medium A, which is fed into each of the spaces above and below the printing roller unit 100 by the upper rollers 210 and the lower rollers 220.

The roller sensor unit 400 comprises a printing roller sensor 410 for sensing the rotating speed of the printing roller unit 100, an upper roller sensor 420 for sensing the rotating speed of the upper rollers 210, and a lower roller sensor 430 for sensing the rotating speed of the lower rollers 220.

The control unit 500 controls the rotation of the printing roller unit 100, the upper rollers 210 and the lower rollers 220 on the basis of the information sensed in the printer medium sensor unit 300 and the roller sensor unit 400.

The printing roller unit 100 will now be described.

As described above, the pluralities of droplet-ejecting inkjet heads **100*h* are arranged at the outer circumferential portion of the printing roller unit 100. Each of the droplet-ejecting inkjet heads 100*h* comprises a body 110, a chamber 112 formed in the body 110 so as to receive a given amount of fluid containing liquids and particles (hereinafter abbreviated as "fluid"), a nozzle 114 for ejecting the fluid, formed at one side of the body 110 so as to communicate with the chamber 221, and an actuator for forming an electrostatic field so as to eject the fluid through the nozzle 114**.

The droplet-ejecting inkjet heads **100*h*** will now be described in detail.

The droplet-ejecting inkjet head **100*h* is an element for ejecting droplets using an electrostatic field and comprises the chamber 112, the body 110 having the nozzle formed therein, and the actuator 120 which forms an electrostatic field so as to eject fluid through the nozzle 114 of the body 110**.

The chamber 112 of the body 110 forms a given space in the body 110 to receive a given amount of fluid from the outside, and the nozzle 114 of the body 110 is a hole-shaped portion formed at one side of the body 110 so as to communicate with the chamber 112.

Meanwhile, the above-described chamber 112 and nozzle 114 may consist of pluralities of chambers 112 and pluralities of nozzles 114 communicating with respective chambers 112. When the pluralities of chambers 112 and nozzles 114 are provided, there is an advantage in that the chambers 112 can respectively receive different kinds of fluids. In addition, the chambers 112 can be provided with spaces, which can store fluid in the printing roller unit 100, so as to communicate with the respective spaces. That is, the chambers 112 may have a structure which allows fluid to be supplied into each of the chambers 112.

The actuator 120 serves to form an electrostatic field such that the fluid received in the chamber 112 can be ejected through the nozzle 114. Specifically, it comprises an electrode, placed in the chamber 112 or the nozzle 114, an electrode plate disposed at one side of the body 110, and a power supply for applying voltage between the electrode and the electrode plate. It is to be understood that a plurality of the electrode plates can be disposed in parallel. Herein, the electrode may also be formed on the wall side of the chamber 112 or the nozzle 114 through a vapor deposition process.

In one embodiment of the actuator 120 having the above-described construction, the positive (+) pole and the negative (−) pole are connected to the electrode and the electrode plate, respectively, and voltage is applied between the electrode and the electrode plate from the power supply. Then, fluid received in the chamber 112 of the body is ejected toward the electrode by electrospray ejected through the nozzle 114 of the body 110.

Pluralities of the droplet-ejecting inkjet heads **100*h* having the above-described construction are arranged at the outer circumferential portion of the printing roller unit 100. Herein, the printing roller unit 100** can rotate in the forward or reverse direction.

Meanwhile, an electrical signal for forming an electrostatic field in the actuator 120 of the droplet-ejecting inkjet head 120 may be a continuous DC voltage signal, a signal for forming an electrostatic field in the form of a DC voltage pulse, an AC voltage signal having a certain frequency, or a continuous DC signal which is applied along with AC voltage.

When a continuous DC voltage signal is applied, the interface of liquid is electrically charged, and the charges move in a direction tangential to the interface, while the generated electrostatic force is concentrated in the interface and, at the same time, liquid droplets can be formed and ejected. However, in the case of the continuous signal, liquid droplets can be formed and ejected under very limited conditions, the change of the interface and the mode of jetting vary depending on the magnitude of voltage applied and the electrical conductivity, surface tension coefficient, viscosity, etc. of the liquid.

When a DC voltage pulse is applied in order to overcome this phenomenon, electrostatic force acts on the interface of the liquid only for a limited time, and thus drop-on-demand droplets can be produced and ejected at a desired point of time. In the case of a continuous jet or a cone-jet, droplets can be formed by cutting the continuous jet.

However, even in this case, droplets can be effectively produced only when optimal conditions, determined according to applied voltage and the physical properties of liquid, are present. Namely, in order to produce drop-on-demand droplets at a desired point of time, a pulse having an optimal voltage and frequency, determined according to the properties of ink, must be applied.

Meanwhile, electrospray studies indicate that a change in the liquid interface is also producible through the use of AC voltage. Thus, in this embodiment, the production and ejection of droplets by AC voltage are proposed. In addition, when a DC voltage in the range in which liquid ejection or droplet production does not occur is applied while applying an AC voltage having a specific frequency in order to increase the efficiency and effect of droplet production, droplets can be formed and ejected at a frequency proportional to the corresponding frequency, and more stable optimal conditions can be provided.

Meanwhile, a pattern mask P may be provided on the surface of the printing roller unit 100, and the surface of the print medium A may also be patterned by forming an electrostatic field between the nozzle 114 and the pattern mask P.

Specifically, the pattern mask P is formed in the surface of the printing roller unit 100, and the inkjet head **100*h*, which is an electrospray device, is included in the printing roller unit 100. Thus, fine liquid sprays from the nozzle 114** passes through the pattern mask to form a pattern on the surface of the print medium A.

Then, the transport roller unit 200 will be described.

As described above, the transport roller unit 200 comprises the upper rollers 210 and the lower rollers 220. The upper rollers 210 are provided above the printing roller unit 100 and rotate so as to feed the print medium A into the space above the print roller unit 100, and the lower rollers are provided below the printing roller unit 100 and rotate so as to feed the print medium A into the space below the print roller unit 100.

Figure 4:
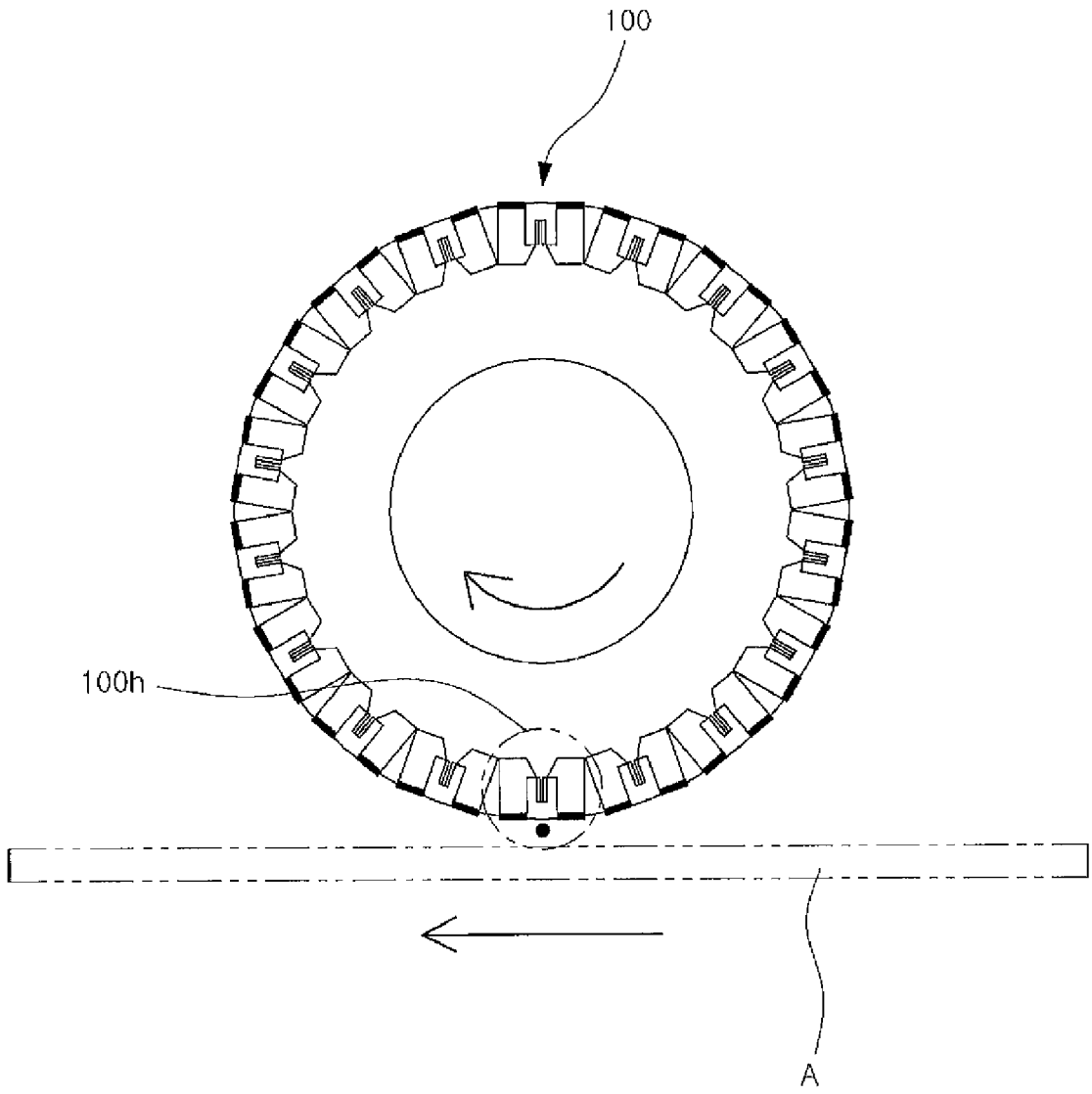
FIGS. 4 and 5 are schematic cross-sectional views of a roll-to-roll printing system according to one embodiment of the present invention.
Figure 5:
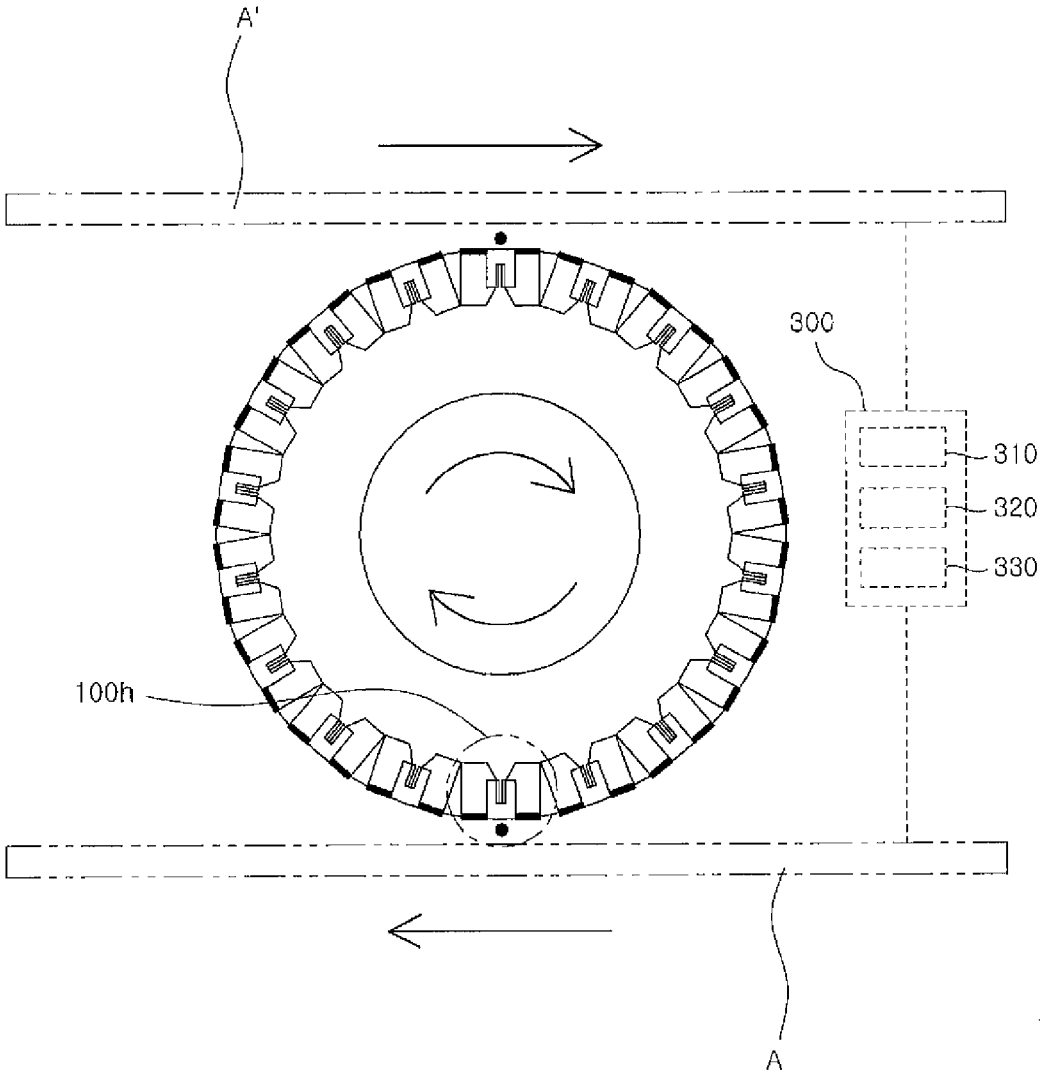
Figure 6:
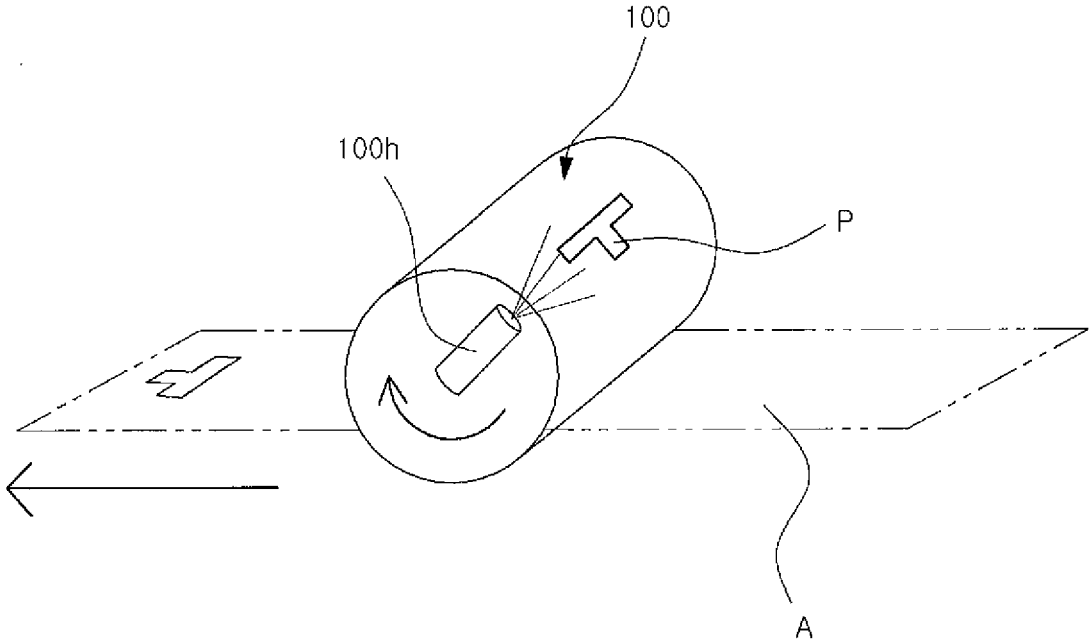
FIG. 6 is a conceptual diagram illustrating the formation of a pattern through a roll-to-roll printing system according to one embodiment of the present invention.

Meanwhile, the upper rollers 210 and the lower rollers 220 can rotate in the forward or reverse directions, same as the printing roller unit 100 can. Thus, the print medium B can be fed in either direction, because the printing roller unit 100, the upper rollers 210 and the lower rollers 220 can all rotate in the forward or reverse directions. Specifically, although FIG. 4 shows that the print medium A is transported from the right side to the left side in the space below the printing roller unit 100, it is also possible that the print medium A be transported from the left side to the right side in the space below the printing roller unit 100.

The upper rollers can be provided at both sides of the space above the printing roller unit 100, respectively, and the lower rollers 220 can be provided at both sides of the space below the printing roller unit 100.

Meanwhile, the print medium A that is transported by the upper rollers 210 can be supported by support means, such that it does not drop due to gravity. Such support means may be composed of transport rollers, which rotate such that the print medium A can be transported according to the drive of the upper rollers 210.

Then, the print medium sensor unit 300 will be described.

As described above, the print medium sensor unit 300 comprises the position sensor 310, the feed speed sensor 320 and the vibration sensor 330. Herein, the position sensor 310 senses the position of the print medium A, which is fed into each of the spaces above and below the printing roller unit 100 by the upper rollers 210 and the lower rollers 220, and the feed speed sensor 320 senses the feed speed of the print medium A, which is fed into each of the spaces above and below the printing roller unit 100 by the upper rollers 210 and the lower rollers 220. In addition, the vibration sensor 330 senses the vibration of the print medium A, which is fed into each of the spaces above and below the printing roller unit 100 by the upper rollers 210 and the lower rollers 220.

Then, the roller sensor unit 400 will be described.

As described above, the roller sensor unit 400 comprises the printing roller sensor 410, the upper roller sensor 420 and the lower roller sensor 430. Herein, the printing roller sensor 410 senses the rotating speed of the printing roller unit 100, the upper roller sensor 420 senses the rotating speed of the upper rollers 210, and the lower roller sensor 430 senses the rotating speed of the lower rollers 220.

Next, the control unit 500 will be described.

As described above, the control unit 500 controls the rotation of the printing roller unit 100, the upper rollers 210 and the lower rollers on the basis of the information sensed in the position sensor 310, feed speed sensor 320 and vibration sensor 330 of the print medium sensor unit 300 and the information sensed in the printing roller sensor 410, upper roller sensor 420 and lower roller sensor 430 of the roller sensor unit 400.

Figure 7:
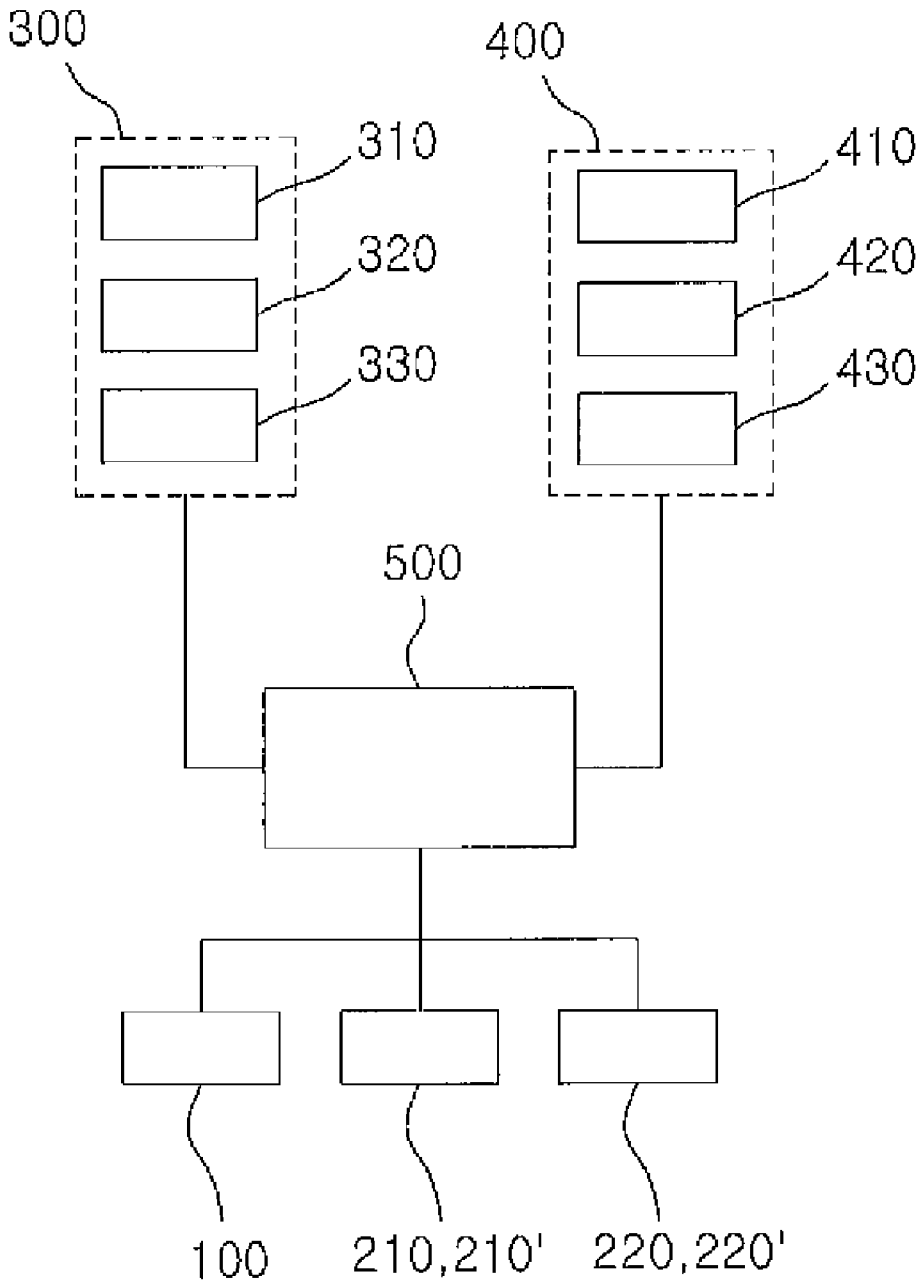
FIG. 7 is a block diagram showing the correlation between a print medium sensor unit, a roller sensor unit and a control unit in a roll-to-roll printing system according to one embodiment of the present invention.

Specifically, as shown in FIG. 7, the control unit 500 controls the rotation of the printing roller unit 100, the upper rollers 210 and the lower rollers 220, such that the relative speed of the print medium A, which is fed into each of the spaces above and below the printing roller unit 100, relative to the rotating outer circumferential surface of the printing roller unit 100, is close to "0".

Hereinafter, a roll-to-roll printing method, which is performed using the above-described roll-to-roll printing system, will be described.

The roll-to-roll printing method generally comprises the steps of: providing a printing roller unit 100 including droplet-ejecting inkjet heads **100*h*; feeding a print medium A into the space above or below the printing roller unit 100; controlling the rotating speed of the printing roller unit 100 and the feed speed of the print medium A, such that the relative speed of the print medium A (which is being fed), relative to the outer circumferential surface of the printing roller unit 100**, is close to "0"; and forming an electrostatic field.

In detail, the roll-to-roll printing method generally comprises the following steps:

a) a step of providing a printing roller unit 100 including droplet-ejecting inkjet heads **100*h***.

As described above, the printing roller unit 100 having pluralities of droplet-ejecting inkjet heads **100*h* arranged at the outer circumferential portion thereof is provided, in which each of the droplet-ejecting inkjet heads 100*h* comprises a body 110, a chamber 112 formed in the body 110 so as to receive a given amount of fluid, a nozzle 114 for ejecting the fluid, formed at one side of the body 110 so as to communicate with the chamber 112, and an actuator 120** for forming an electrostatic field so as to eject the fluid through the nozzle.

b) a step of feeding a print medium A into the space above or below the printing roller unit 100.

As described above, the print medium A is fed into the space above or below the printing roller unit 100 by the upper rollers 210 or the lower rollers 220.

c) a step of controlling the rotating speed of the printing roller unit 100 and the feed speed of the print medium A, such that the relative speed of the print medium A (which is being fed), relative to the outer circumferential surface of the printing roller unit 100, is close to "0".

In this step, the position, feed speed and vibration of the print medium A are sensed, and based on the sensed values of position, feed speed and vibration of the print medium A, the rotating speed of the printing roller unit 100 and the feed speed of the print medium A are controlled such that the relative speed of the print medium A, which is being fed, relative to the outer circumferential surface of the printing roller unit 100, is close to "0".

d) a step of forming an electrostatic field.

In this step, an electrostatic field is formed through the actuator 120, such that the fluid can be ejected through the nozzle 119 and can be printed on the print medium A.

Figure 8:
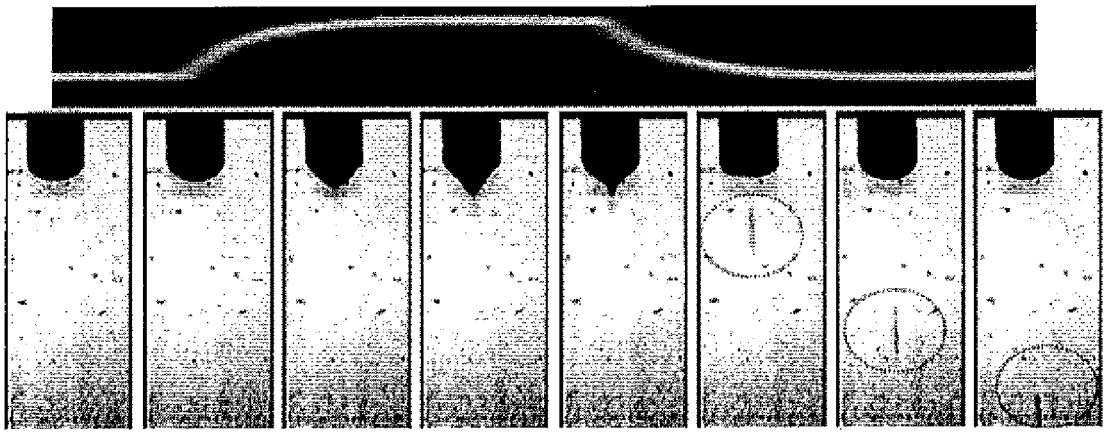
FIG. 8 is a tomograph showing the state in which droplets are ejected through the droplet-ejecting inkjet heads of a roll-to-roll printing system according to one embodiment of the present invention.
Figure 9:
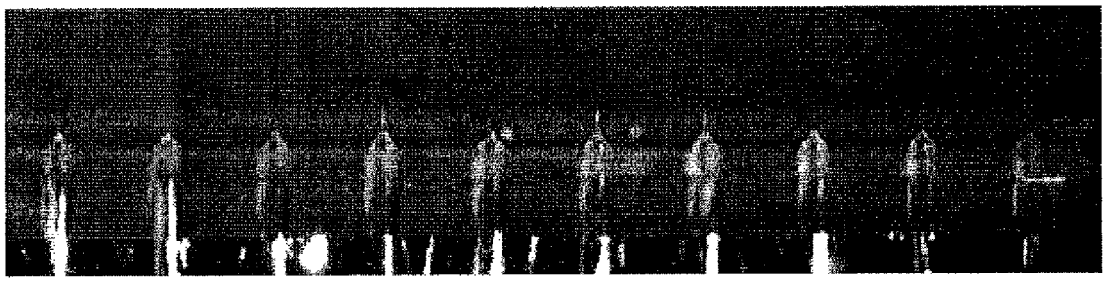
FIG. 9 is a photograph showing the state in which droplets are ejected through the droplet-ejecting inkjet heads of a roll-to-roil printing system according to one embodiment of the present invention.

Meanwhile, FIG. 8 is a tomograph showing the state in which droplets are ejected through the droplet-ejecting inkjet heads, and FIG. 9 is a photograph showing the state wherein droplets are ejected through the droplet-ejecting inkjet heads.

Although the preferred embodiment of the present invention has been described for illustrative purposes with reference to the accompanying drawings, those skilled in the art will appreciate that various modifications, additions and substitutions are possible, without departing from the scope and spirit of the invention as disclosed in the accompanying claims.

The invention claimed is:

1. A roll-to-roll printing system, comprising:

a printing roller unit having pluralities of droplet-ejecting inkjet heads arranged at the outer circumferential portion thereof, each of the droplet-ejecting inkjet heads comprising a body, a chamber formed in the body so as to receive a given amount of fluid, a nozzle for ejecting the fluid, formed at one side of the body so as to communicate with the chamber, and an actuator for forming an electrostatic field so as to eject the fluid through the nozzle;

a transport roller unit comprising upper rollers, which rotate so as to feed a print medium into a space above the printing roller unit, and lower rollers, which rotate so as to feed the print medium into a space below the printing roller unit;

a print medium sensor unit comprising a position sensor for sensing the position of the print medium, which is fed into each of the spaces above and below the printing roller unit by the upper rollers and the lower rollers, a feed speed sensor for sensing the feed speed of the print medium, which is fed into each of the spaces above and below the printing roller unit by the upper rollers and the lower rollers, and a vibration sensor for sensing the vibration of the print medium, which is fed into each of the spaces above and below the printing roller unit by the upper rollers and the lower rollers;

a roller sensor unit comprising a print roller sensor for sensing the rotating speed of the printing roller unit, an upper roller sensor for sensing the rotating speed of the upper rollers, and a lower roller sensor for sensing the rotating speed of the lower rollers; and a control unit for controlling the rotation of the printing roller unit, the upper rollers and the lower rollers on the basis of the information sensed in the print medium sensor unit and the roller sensor unit.

2. The roll-to-roll printing system of claim 1, wherein the control unit controls the rotation of the printing roller unit, the upper rollers and the lower rollers, such that the relative speed of the print medium, which is fed into each of the spaces above and below the printing roller unit, relative to the outer circumferential surface of the printing roller unit, which rotates, is close to "0".

3. The roll-to-roll printing system of claim 1, wherein the printing roller unit, the upper rollers and the lower rollers can rotate in a forward or reverse direction, such that the print medium can be fed in either direction.

4. The roll-to-roll printing system of claim 1, wherein an electrical signal for forming the electrostatic field in the actuator of the droplet-ejecting inkjet head is a continuous DC voltage signal, a signal for forming an electrostatic field in the form of a DC voltage pulse, an AC voltage signal having a specific frequency, or a continuous DC signal which is applied along with AC voltage.

5. The roll-to-roll printing system of claim 1, wherein a pattern mask is provided on the surface of the printing roller unit, and an electrostatic field is formed between the nozzle and the pattern mask to form a pattern on the surface of the print medium.

6. A roll-to-roll printing method, comprising the steps of:

providing a printing roller unit having pluralities of droplet-ejecting inkjet heads arranged at the outer circumferential portion thereof, each of the droplet-ejecting inkjet heads comprising a body, a chamber formed in the body so as to receive a given amount of fluid, a nozzle for ejecting the fluid, formed at one side of the body so as to communicate with the chamber, and an actuator for forming an electrostatic field so as to eject the fluid through the nozzle;

feeding a print medium into a space above or below the printing roller unit;

sensing the position, feed speed and vibration of the print medium, and controlling the rotating speed of the printing roller unit and the feed speed of the print medium on the basis of the sensed values of position, feed speed and vibration of the print medium, such that the relative speed of the rotating print medium, relative to the outer circumferential surface of the printing roller unit, is close to "0"; and forming an electrostatic field, such that the fluid is ejected through the nozzle.

* * * * *